United States Patent [19]

Bennett

[11] 4,294,294

[45] Oct. 13, 1981

[54] CONTROL SYSTEM FOR FILLING MACHINE

[75] Inventor: Richard N. Bennett, Arbutus, Md.

[73] Assignee: National Instrument Company, Inc., Baltimore, Md.

[21] Appl. No.: 119,317

[22] Filed: Feb. 7, 1980

[51] Int. Cl.[3] ..... B65B 43/56

[52] U.S. Cl. ..... 141/179; 141/180; 141/183; 141/181

[58] Field of Search ..... 141/129–191, 141/250–284; 198/425, 444, 491

[56] References Cited

U.S. PATENT DOCUMENTS 4,083,389 4/1978 Rosen et al. ..... 141/179

*Primary Examiner*—Houston S. Bell, Jr.

*Attorney, Agent, or Firm*—Craig and Antonelli

[57] ABSTRACT

An automatic high-speed filling machine with lowerable nozzles for simultaneously filling a predetermined number of containers, in which the control of the machine is transferred to the star wheel of the indexing mechanism, when the star wheel is released after completion of the filling operation; the drive actuating the filling units is thereby stopped while the star wheel performs its indexing function during rotation thereof.

9 Claims, 3 Drawing Figures

CONTROL SYSTEM FOR FILLING MACHINE

The present invention relates to high-speed automatic filling machines and more particularly to a control system for such filling machines which enables a rapid and accurate filling of the containers.

Filling machines of the type, to which the present invention relates, are known as such in the prior art, for example, as described in the U.S. Pat. No. 2,807,213, in which small containers are fed on a conveyor into their filling position underneath lowerable nozzles of the filling machine, where the containers are held stationary in a predetermined position by an indexing mechanism while the nozzles are lowered and thereafter discharge the product to be filled into the containers. As soon as the filling operation is completed, the nozzles are raised out of the containers, whereupon the movement of the filled containers is again released by the indexing mechanism to permit the next batch of empty containers to be placed underneath the nozzles. To avoid spillage, it is necessary that the containers be placed and held accurately underneath the lowerable nozzles. Additionally, the movement of the small containers moving on a continuously moving conveyor belt has to be positively stopped, once the predetermined number of containers reach their filling position underneath the nozzles and released again as soon as the nozzles have cleared the filled containers.

An indexing system utilizing a star-wheel, which has proved highly successful, is disclosed in the U.S. Pat. No. 4,083,389, in which the star-wheel is freely rotatably mounted so as to be driven by engagement of successive containers moved by the conveyor, and in which a stop pin projects directly from the star wheel to engage with a stop member adapted to be momentarily retracted so as to release the star-wheel at that instant of an operating cycle, when the filling nozzles approach their raised position upon completion of a filling operation. The star wheel will then freely rotate until the next stop pin engages with the stop member to stop the star-wheel, which takes place after a predetermined number of containers have passed the star-wheel. In the machine as disclosed in U.S. Pat. No. 4,083,389, a cam shaft, driven by the motor which also drives the filling units, includes a number of cams, one of which causes retraction of the stop member when the nozzles approach their raised position. The motor itself and therewith the cam shaft rotate continuously during the operation of the machine so that the time available for bringing in a new batch of containers to be filled must take place during that portion of the rotation of the cam shaft, during which the nozzle support remains in its raised position i.e., before commencement of the discharge stroke of the filling units. While the electric motor is normally adjustable in its speed and the filling units are capable in most cases of operating faster for a given product to be discharged than the actual speed setting used under these conditions, a maximum speed for the electric drive motor and therewith for the cyclic operation of the filling units is imposed by the maximum conveyor speed, at which the machine can be operated safely to remove the filled containers and bring in a new batch of empty containers without tipping any container and therewith without spillage of the fluid product, as disclosed in my prior U.S. Pat. No. 4,073,322. As a result thereof, the maximum speed of the filling machine is determined by the maximum possible speed of the conveyor and by the time necessary at such conveyor speed during a given cycle of operation of the filling units to remove the filled containers and to bring a new batch of containers into filling position.

Apart from the speed limitations thus imposed on the filling machine by the maximum safe conveyor speed, the prior art machines also required a more or less accurate adjustment to correlate the speed of the conveyor, itself adjustable, to the speed of the electric drive motor driving the cam shaft and the filling units.

For example, if it is assumed that 180 bottles per minute each having 1.7 inches in diameter are to be filled with a prior art filling machine which could fill 33 to 35 bottles per minute per nozzle; then this would require a six-nozzle machine which would have to operate with a conveyor speed as follows:

$$1.7 \times 1.2 \times 6 \times 3 \times 30 = 91.8 \text{ feet/min. (belt speed)}$$

wherein 1.7 is the diameter of a bottle, 1.2 is a slip factor, 6 represents the number of nozzles for simultaneous filling, 3 is a formula constant and 30 represents the theoretical number of fills per minute per nozzle. The resulting conveyor belt speed of 91.8 feet per minute, however, is excessive since the maximum safe speed is about 70 to 75 feet per minute, if good container handling is to be achieved with the prior art machine. At a conveyor belt speed of 76 feet per minute, the actual production rate for this prior art machine would therefore be 150 bottles per minute.

The present invention is therefore concerned with the task to eliminate the aforementioned shortcomings and drawbacks encountered with the prior art filling machines and to provide a control system for a filling machine of the type described above, which permits a substantial increase in the production rate without an attendant increase in conveyor speed.

The underlying problems are solved according to the present invention in that the star-wheel of the indexing mechanism takes over control of the d.c. drive motor in such a manner that the d.c. motor is stopped in the single cycle position after the star-wheel is released by retraction of the stop member and continues to be stopped until the next time a stop pin again abuts against the stop member. This means in practice that the speed of the d.c. drive motor can now be considerably increased to increase the discharge and suction stroke of the filling units since the drive motor is de-energized during the period of time during which the star-wheel rotates and performs its indexing function by such rotation through the predetermined angle to indicate that the predetermined number of containers just filled has left the filling station and a corresponding number of empty containers has arrived at the filling station. The rotation of the d.c. motor starts again, once the star-wheel has completed its predetermined angular rotation and is stopped again by the stop member. Thus, the control of the cyclic operation of the filling machine between release of the star-wheel and arrival of the new batch of empty containers is controlled exclusively by the star-wheel itself.

This offers a number of significant advantages as follows. As pointed out above, the speed of operation of the drive motor can be substantially increased so that with a given conveyor speed, the production rate can also be considerably increased. If again 180 bottles are to be filled with the control system of the present invention, utilizing the factors of the equation above, one obtains the following conveyor belt speed:

$$1.7\times1.2\times3\times180\times(12\times35)/180=39.4 \text{ feet/minute (conveyor belt)}$$

wherein 1.7 is again the diameter of a container, 1.2 the slip factor, 3 a formula constant, 180 the desired speed, 12 is the number of filling units used in this example, 35 is the actual number of bottles that can be filled in one minute by one unit, and 180 is the actual desired production rate from the machine.

Actual tests have not only confirmed the results obtained with the control system according to the present invention but have indicated that they are even better than expected from the above equation.

In one preferred embodiment according to the present invention, a microswitch is mounted adjacent to the air cylinder retracting the stop member, in such a manner that the microswitch is closed when the stop pin of the star-wheel comes into abutment against the stop member. Closing of the microswitch causes a timing control circuit to momentarily energize a relay which closes the armature circuit for the d.c. motor and at the same time also closes a holding circuit to keep the winding of this relay energized. The relay remains energized, i.e., the d.c. motor continues to drive the cam shaft and the filling units until a normally closed single-cycle switch is opened by the cam shaft, when the nozzle support approaches its raised position. This opens the relay holding circuit and thereby causes the relay to be de-energized which in turn cause the armature circuit to be opened until such time as the microswitch is again closed by the star-wheel after its predetermined angular rotation. The timing control circuit is thereby so constructed by conventional means that the relay winding can be re-energized momentarily by the timing circuit only after the microswitch has been opened by rotation of the star-wheel and is thereafter closed again by arrival of the star-wheel in its next stop position; on the other hand, energization of the relay winding by the timing control circuit is impossible until the microswitch has been opened, whereupon the timing control circuit will again permit re-energization for a short period of time of the relay winding when the microswitch is thereafter closed again.

Apart from a substantial increase in the production rate, the present invention offers other significant advantages. An anti-back-up device, as required heretofore becomes unnecessary. If, for example, the containers stop downstream from the filling position, the bottles will stop moving on the conveyor and thereby stop the star-wheel. If the star-wheel itself does not move for a full complement of containers, the filling machine cannot start the next following cycle. After the bottles are cleared downstream of the filling position, the star-wheel will rotate to its stop position and then initiate the next filling cycle.

With the control system of the present invention, the production rate can be increased by simply adding additional filling units, without the need for also increasing the conveyor speed.

The filling machine itself can be adjusted to fill the bottles at the maximum speed possible for the given container size and for a given product without consideration of maximum conveyor speed. There is no limit on the number of nozzles in the machine by the speed of the conveyor necessary to advance a corresponding number of containers into the filling position as was the case with the prior art machines. Additionally, the conveyor itself can be operated also at higher speeds because the bottles will always be at full rest before the filling operation commences, as controlled by the stopped star-wheel which, when stopped, indicates that the correct number of filling units have arrived at the filling station in proper stopped position.

The danger of spillage is greatly decreased by the control system of the present invention, which is important in particular with molten materials such as shoe polish which would quickly solidify after it is spilled.

Accordingly, it is an object of the present invention to provide a filling machine and control system therefor which avoids by simple means the aforementioned shortcomings and drawbacks encountered in the prior art.

Another object of the present invention resides in a control system for high-speed filling machines which permits a substantial increase in the rate of production.

A further object of the present invention resides in a control system for high-speed filling machines which is fool-proof, yet extremely simple.

Still a further object of the present invention resides in a control system for high-speed filling machines which permits a much wider choice in the number of nozzles to be used with the machine while at the same time increasing the production rate by the addition of filling nozzles over and above that attainable heretofore by such addition.

Still another object of the present invention resides in a control system for high-speed filling machines which is simple in construction, highly reliable in operation, and fully automatic in its functioning.

A further object of the present invention resides in a control system for high-speed filling machines which permits an increase not only in the filling operation but also in the conveyor speeds due to the automatic monitoring of the safe arrival of the containers and stoppage thereof before the filling operation resumes.

These and other objects, features and advantages of the present invention will become more apparent from the following description when taken in connection with the accompanying drawing which shows, for purposes of illustration only, one embodiment in accordance with the present invention, and wherein.

Figure 1:
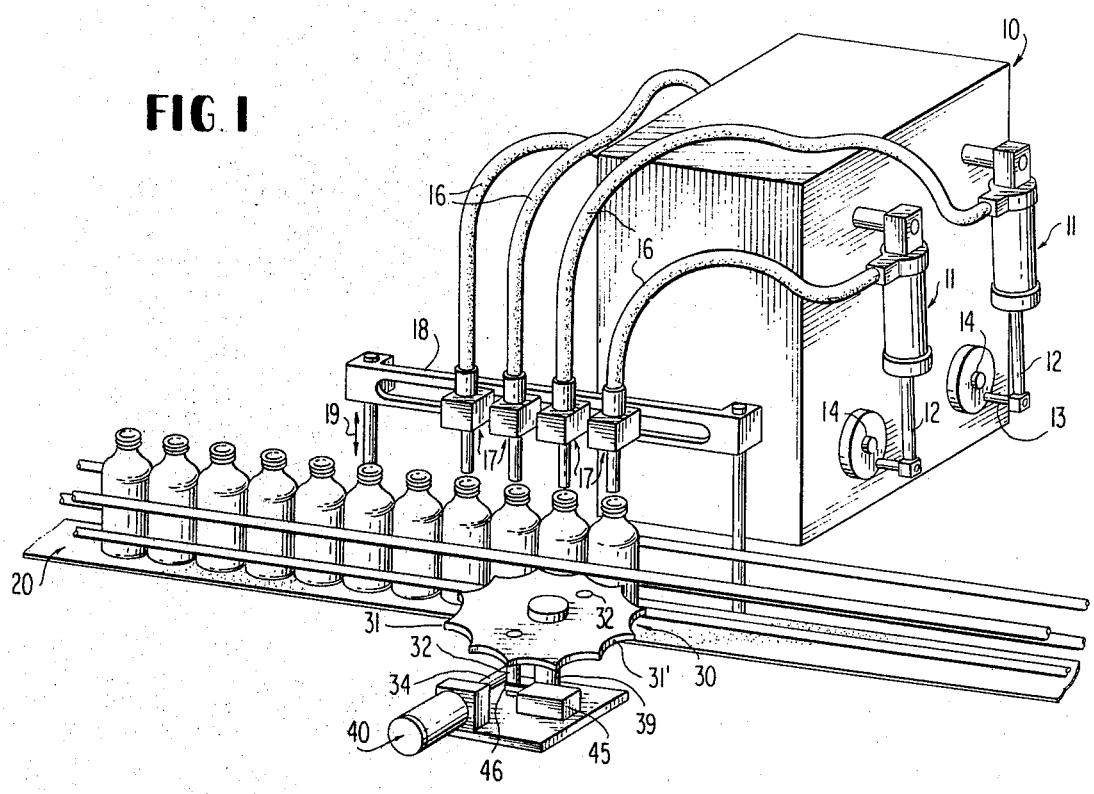
FIG. 1 is a somewhat schematic perspective view of a filling machine equipped with a control system including a star-wheel indexing mechanism in accordance with the present invention.

Referring now to the drawing wherein like reference numerals are used throughout the various views to designate like parts, and more particularly to FIG. 1, reference numeral 10 generally designates a high-speed filling machine of any known construction which includes a predetermined number of pump or filling units generally designated by reference numeral 11, corresponding to the number of nozzles in the machine of which only two pump units are shown while two more pump units are located on the opposite side of the filling unit. Of course, the filling machine may also be of the type as disclosed in the U.S. Pat. No. 4,077,441 to increase the number of filling units with a given drive mechanism, for example, to eight, twelve or sixteen filling units and thus to a filling machine with eight, twelve or sixteen nozzles. Each filling unit which forms a pump unit, includes a piston (not shown) connected with a piston rod 12 which is reciprocated by rotation of an eccentric crank pin 13 pivotally connected therewith and driven by a respective pump shaft 14.

Each pump or filling unit 11 also includes an intake (not shown) and a discharge which is connected by way of a flexible hose 16 with a filling nozzle 17, fixedly mounted on a vertically reciprocable nozzle support structure 18 which causes by conventional means the lowering and raising of the nozzles 17 in timed relation to the filling cycle as schematically indicated by the double arrow 19.

A conveyor belt 20 which frequently is a continuously operating conveyor belt, feeds the empty bottles to their filling positions in the filling machine underneath the filling nozzles 17, where the empty containers are stopped by an indexing mechanism while being filled, and then continues to transport the filled containers away from the filling station after completion of the filling operation. As already disclosed in the U.S. Pat. No. 4,083,389, the indexing system includes a star-wheel generally designated by reference numeral 30 which has a predetermined number of equi-spaced radially outwardly projecting prongs 31, so connected by curved portions 31' conforming to the contour of the containers so as to form container-receiving pockets. The star-wheel 30 is freely rotatable on shaft 39 and in fact is actuated or driven by the movement of the containers on the conveyor belt 20 as they successively come into contact with the respective prongs 31, unless the star-wheel 30 is stopped in a predetermined position. For purposes of stopping the star-wheel 30, the latter is provided with one or several downwardly projecting stop pins 32 which is or are adapted to be engaged by an electrically or pneumatically operated stop member 34 normally projecting into the path of the downwardly projecting stop pin or pins 32. An electromagnet generally designated by reference numeral 40 which is mechanically connected with the retractable stop member 34 is adapted to momentarily retract the stop member 34 upon energization thereof so as to momentarily release movement of the star-wheel 30 when a cam mounted on the shaft 51 which may be the motor shaft, the pump shaft or any other shaft rotating in unison with and driven by the motor generally designated by reference numeral 50, closes the energizing circuit for the electromagnet 40, as disclosed in the aforementioned U.S. Pat. No. 4,083,389. The filling machine, so far described, is known in the prior art, may be of any conventional construction and forms no part of the present invention and therefore is not described in further detail herein.

According to the present invention, a microswitch generally designated by reference numeral 45 which includes a movable switch member 46, is mounted on the machine in such position that the switch member 46 is actuated, i.e., the microswitch is closed when the star-wheel 30 is in its stopped position, in which the stop pin 32 thereof is in engagement with and stopped by the stop member 34.

Figure 2:
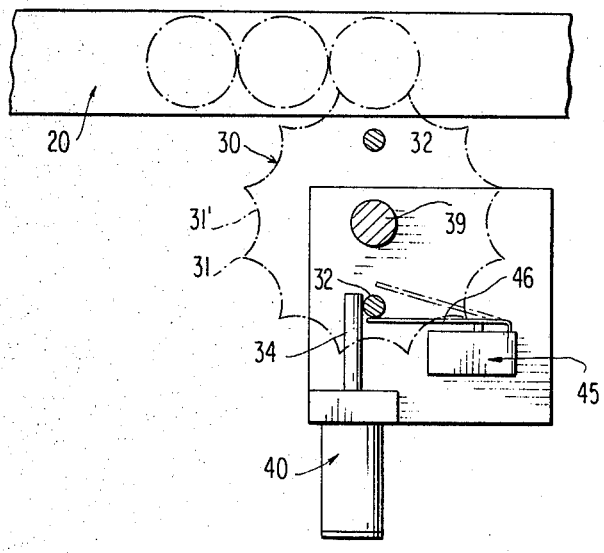
FIG. 2 is a top plan view on the star-wheel indexing mechanism according to the present invention.
Figure 3:
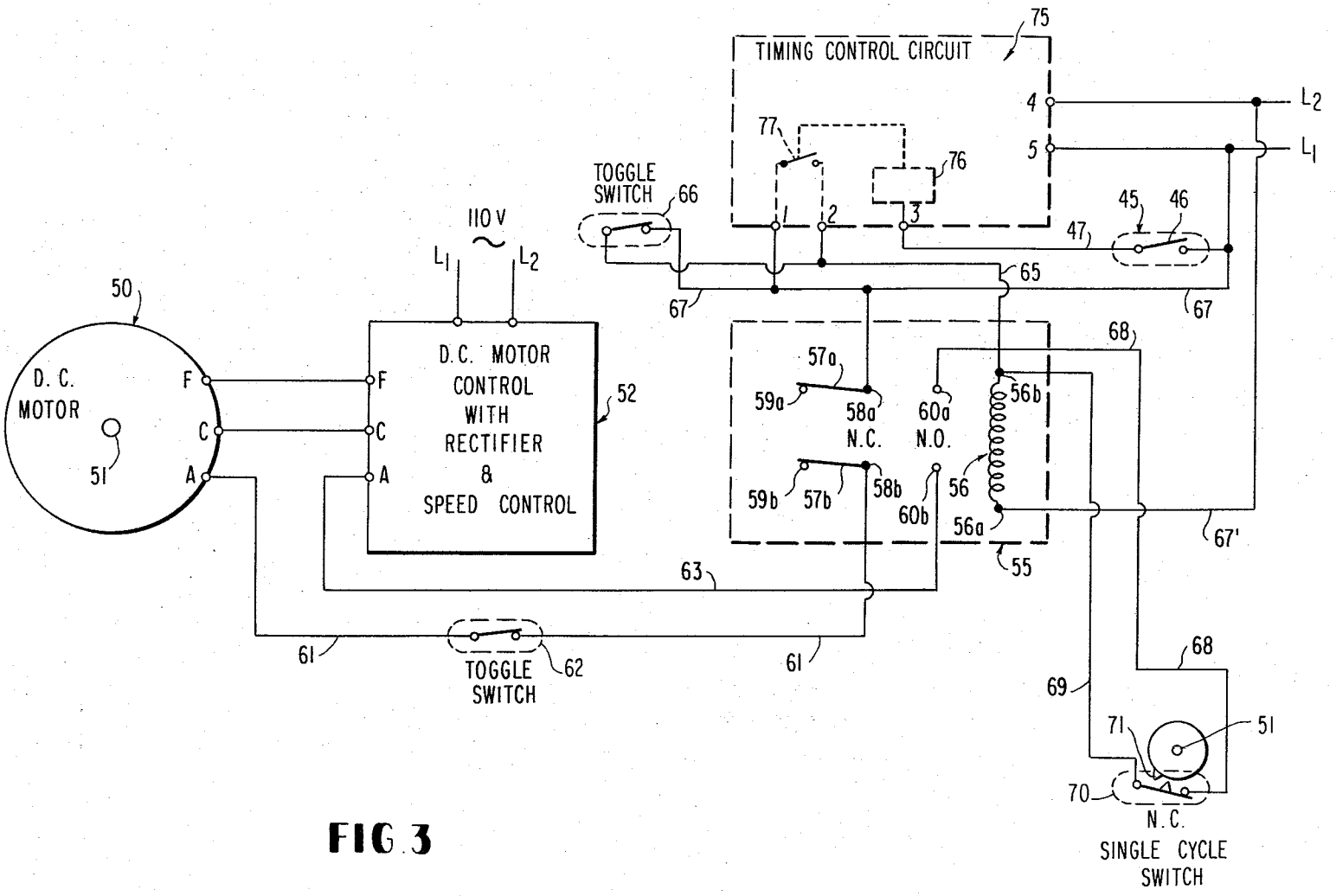
FIG. 3 is a schematic diagram illustrating the control circuit used with the indexing mechanism of the present invention.

FIG. 3 shows the control circuit in accordance with the present invention. The d.c. motor generally designated by reference numeral 50 includes a drive shaft 51 which is drivingly connected with the pump shafts by conventional means. A conventional d.c. motor control including rectifiers and speed control (not shown) which is generally designated by reference numeral 52 is connected at its terminals to the 110 volt a.c. lines $L_1$ and $L_2$, while its terminal F is connected with the field terminal F (field winding) of the d.c. motor 50, its terminal C (common) is connected with the terminal C (common) of the motor 50. The armature terminal A of the d.c. motor 50 is connected by way of line 61 which includes a toggle switch 62 constituting an emergency stoppage switch, with the fixed terminal **58*b* of a relay generally designated by reference numeral 55 which includes an energizing winding 56. The movable contact members 57*a* and 57*b* permanently connected with the terminals 58*a* and 58*b* normally are in engagement with the terminals 59*a* and 59*b* of the de-energized relay 55. When the winding 56 of relay 55 is energized, movable contact members 57*a* and 57*b* engage with terminals 60*a* and 60*b*. As can be seen, energization of relay 55 thus closes the armature circuit from terminal A of the d.c. motor control 52 by way of line 63, terminal 60*b*, movable contact member 57*b*, terminal 58*b*, and line 61 with switch 62 closed. At the same time, energization of the relay 55 also closes a holding circuit from a.c. line $L_1$, line 67, terminal 58*a*, movable contact member 57*a*, terminal 60*a*, line 68, normally closed contact of single-cycle switch generally designated by reference numeral 70, and line 69 leading to the upper terminal 56*b* of the energizing winding 56 whose lower terminal 56*a* is permanently connected with the a.c. line $L_2$ by way of line 67'. Energization of the relay 56 can take place by means of toggle switch 66 which is a continuously running switch, from a.c. line $L_1$, line 67, closed toggle switch 66 and line 65. However, toggle switch 66 is normally open when automatic single-cycle operation is desired. For automatic operation, the star-wheel actuated microswitch 45 (FIGS. 1, 2 and 3) is connected in a circuit including a line 47 (FIG. 3) that connects the a.c. line $L_1$ with terminal 3 of a timing control circuit generally designated by reference numeral 75 and of any conventional construction. The timing control circuit 75 is thereby so constructed and arranged that a connection is established for only a short period of time between its terminals 1 and 2 when the microswitch 45 is closed by the star-wheel 30 in its stopped position to thereby only momentarily energize relay 56 by connecting its winding terminal 56*b* with a.c. line $L_1$. Since relay 55 will remain energized by its holding circuit 68, 70, 69 until single-cycle switch 70 opens momentarily when the nozzle support structure 18 approaches its raised position, it is necessary that switch member 46 of microswitch 45 be first allowed to open by release of the star-wheel before relay winding 56 can be re-energized by timing control circuit 75 upon subsequent reclosing of microswitch 45. This can be realized by conventional logic and/or relay-controlled circuits and may include for example, a time-delay relay schematically indicated by reference numeral 76 which will automatically de-energize, for example, one-fourth or one half second after energization thereof by closing of switch member 46, even though the latter remains closed thereafter; relay 76 will thus close the energizing circuit of another relay schematically indicated by switch 77 also only for such very short period of time just sufficient to permit energization of relay 55 which, once energized, will remain energized by its holding circuit as described above until the single-cycle switch 70 will open again as the nozzle support structure 18** reaches its raised position.

OPERATION

The operation of the filling machine according to the present invention is as follows.

Assuming that during the operation of the machine a predetermined number of containers has arrived at the filling station, the star-wheel 30 is stopped by engagement of its stop pin 32 with the stop member 34 and the nozzle support structure 18 just commences its lowering movement to cause the nozzles to enter the containers to be filled. Relay 56 has been previously energized by closure of microswitch 45 and by action of timing control circuit 75 and remains closed by action of its holding circuit since the single-cycle switch 70 which had been opened only momentarily, by now is closed again when the machine had come to a full stop. As a result thereof, the armature circuit of motor 50 is closed by way of line 61, closed switch 62, contact member **57*b* and line 63, and the motor 50 will start to rotate, thereby driving shaft 51 and therewith actuating the pump or filling units 11 which will commence their discharge stroke after the nozzles 17 have entered the containers. Upon completion of the discharge stroke and commencement of the suction stroke, the nozzle support structure 18 will again raise the nozzles out of the containers. At some point, as the nozzle support structure approaches its upper position, the single-cycle switch 70 is momentarily opened by a cam 71 on shaft 51, which causes the holding circuit for relay winding 56 to open up. This in turn causes de-energization of the relay 55 and therewith opening of the armature circuit, thereby stopping the motor 50. At the same time, the electromagnet 40 had been energized by closing its energizing circuit, as described in U.S. Pat. No. 4,083,389, thereby causing temporary retraction of the stop member 34 to permit the star-wheel 30 to start its angular rotation by engagement of successive containers as they pass the star-wheel 30, conveyed by the conveyor 20. As the predetermined number of filled containers has left and an equal number of empty containers has arrived at the filling station, the star-wheel 30 not only has come to a stop by engagement of its stop pin 32 with the stop member 34 but also has closed the switch 46 of microswitch 45 thereby causing re-energization of relay winding 56 for a very short period of time by means of the timing control circuit 75. Energization of relay 55 closes the armature circuit of motor 50 which then starts to rotate to continue the cycle of operation by action of the holding circuit until switch 70 is opened. Even though switch 46 remains closed during the filling operation, the energizing winding 56 cannot be re-energized by the timing control circuit 75 until such time as microswitch 45 has been opened. Consequently, once single-cycle switch 70 opens, the further control of the operation of the machine is transferred to the star-wheel 30 which must first be released to open microswitch 45 before closing of microswitch 45 is again effected to cause energization of relay winding 56 by timing control circuit 75**.

It can be seen from the foregoing that the present invention provides a foolproof automatic system in which the operation of the filling machine is controlled by the star-wheel itself which determines the length of time the d.c. motor 50 remains de-energized while the filled containers are removed and empty containers are installed underneath the nozzles.

While I have shown and described only one embodiment in accordance with the present invention, it is understood that the same is not limited thereto but is susceptible of numerous changes and modifications as known to those skilled in the art. For example, the present invention may also be used with a reciprocating type nozzle filling machine with two or more lanes as described in U.S. Pat. No. 4,073,322. Additionally the conveyor belt(s) may operate continuously or may be controlled so as to stop while the containers are filled. Additionally if the number of nozzles is large, e.g., is sixteen or thirty-two, two star-wheel indexing mechanisms may be provided, each indexing one half the number of containers to be simultaneously filled, which are then interconnected in any known manner. Hence, I do not wish to be limited to the details shown and described herein but intend to cover all such changes and modifications as are encompassed by the scope of the appended claims.

I claim:

1. A control system for a filling machine having filling means operatively connected with nozzle means for simultaneously filling a number of containers corresponding to the number of nozzle means at the filling station, support means for the nozzle means operable to lower and raise the nozzle means into and out of the containers in timed relationship to the filling operation during a given cycle, and control means for controlling the operation of the filling machine including means for actuating the filling means to cause discharge of the product to be filled while the nozzle means are in the containers, means for selectively lowering and raising the nozzle support means in timed relationship to the operation of the filling machine, indexing means with star-wheel means for indexing a predetermined number of containers to be filled at the same time during a given cycle of operation, means for stopping the star-wheel means after a predetermined number of containers are indexed for a given filling operation, and release means for releasing the stop means after completion of a filling operation to permit the filled containers to be removed from the filling station and to permit a predetermined number of containers to be brought to the filling station before the star-wheel means is again stopped by said stop means, characterized by further means operated by movement of the star-wheel means after release thereof by said release means for taking over control of the operation of the filling machine until said star-wheel means again reaches a position thereof indicative of the arrival at the filling station of the predetermined number of containers to be filled during the next cycle of operation.

2. A control system for a filling machine according to claim 1, characterized in that said further means includes switch means actuated by said star-wheel means for disabling at least said actuating means when the star-wheel means leaves its position corresponding to its stopped position.

3. A control system for a filling machine according to claim 2, characterized in that said switch means is operated by a switch-actuating member on the star-wheel means when said star-wheel means is in said stopped position.

4. A control system according to claim 3, characterized in that said switch actuating member is part of the stopping means.

5. A control system according to claim 4, characterized in that said switch actuating member is a stop pin projecting from star-wheel means and adapted to engage with a stop member projecting into its path of rotation.

6. A control system according to claim 1, 2, 3, 4 or 5, in which said actuating means includes an electric motor for driving said filling means, characterized in that said further means includes control circuit means operated by said switch means for disabling energization of said electric motor.

7. A control system for a filling machine according to claim 6, characterized in that said control circuit means includes an energizing circuit for said electric motor controlled by a relay means, said switch means being operable to enable energization of the de-energized relay means only when said switch means is closed after the star-wheel means reaches its stopped position.

8. A control system for a filling machine according to claim 7, characterized in that the relay means includes an energizing circuit, a holding circuit closed by energization of the relay means and operable to be opened when the nozzle support means approaches its raised position, and timing control circuit means for momentarily energizing the relay energizing circuit by closing of said switch means provided said switch means had been opened previously by release of the star-wheel means.

9. A control system for a filling machine having filling means operatively connected with nozzle means for simultaneously filling a number of containers corresponding to the number of nozzle means at the filling station, support means for the nozzle means operable to lower and raise the nozzle means into and out of the containers in timed relationship to the filling operation during a given cycle, and control means for controlling the operation of the filling machine including means for actuating the filling means to cause discharge of the product to be filled while the nozzle means are in the containers, means for selectively lowering and raising the nozzle support means in timed relationship to the operation of the filling machine, indexing means with star-wheel means for indexing a predetermined number of containers to be filled at the same time during a given cycle of operation, means for stopping the star-wheel means after a predetermined number of containers are indexed for a given filling operation and release means for releasing the stop means after completion of a filling operation to permit the filled containers to be removed from the filling station and to permit a predetermined number of containers to be brought to the filling station before the star-wheel means is again stopped by said stop means, characterized in that further control of the filling machine is transferred to the star-wheel means after release thereof by said release means to assume further control of the operation of the filling machine until said star-wheel means again reaches a position thereof indicative of the arrival at the filling station of the predetermined number of containers to be filled during the next cycle of operation.

* * * * *